US007677408B2

(12) United States Patent
Loucks et al.

(10) Patent No.: US 7,677,408 B2
(45) Date of Patent: Mar. 16, 2010

(54) LAUNDRY BASKET WITH HIP HUGGING FEATURE

(75) Inventors: Brandi Loucks, Copley, OH (US); Thomas W. Scherer, Mansfield, OH (US); Fred Reber, Shreve, OH (US)

(73) Assignee: Rubbermaid Incorporated, Huntersville, NC (US)

( * ) Notice: Subject to any disclaimer, the term of this patent is extended or adjusted under 35 U.S.C. 154(b) by 670 days.

(21) Appl. No.: 10/773,389

(22) Filed: Feb. 5, 2004
(Under 37 CFR 1.47)

(65) Prior Publication Data

US 2008/0128436 A1 Jun. 5, 2008

Related U.S. Application Data

(60) Provisional application No. 60/445,278, filed on Feb. 5, 2003.

(51) Int. Cl.
*B65D 25/10* (2006.01)
*B65D 6/00* (2006.01)
*B65D 8/04* (2006.01)

(52) U.S. Cl. ..... 220/756; 220/676; 220/669

(58) Field of Classification Search ..... 220/756, 220/758, 914, 669, 641, 769, 755, 771, 655, 220/676, 657; 224/642, 648
See application file for complete search history.

(56) References Cited

U.S. PATENT DOCUMENTS

| | | | | | |
|---|---|---|---|---|---|
| 2,187,263 | A | * | 1/1940 | Bullock | 220/655 |
| D279,278 | S | * | 6/1985 | Pink | D11/143 |
| 5,133,472 | A | * | 7/1992 | Koda et al. | 220/769 |
| D343,711 | S | * | 1/1994 | Craft et al. | D32/37 |
| D362,931 | S | * | 10/1995 | Brightbill et al. | D32/37 |
| 5,715,968 | A | * | 2/1998 | Fink et al. | 220/669 |
| D416,116 | S | | 11/1999 | Sofy | |
| D425,275 | S | * | 5/2000 | Delouvre et al. | D32/37 |
| 2004/0217555 | A1 | * | 11/2004 | Willat et al. | 277/645 |

* cited by examiner

*Primary Examiner*—Anthony Stashick
*Assistant Examiner*—Shawn M Braden
(74) *Attorney, Agent, or Firm*—Dennis J. Williamson; Moore & Van Allen, PLLC

(57) ABSTRACT

A laundry basket has a bottom panel with a perimeter. A contiguous side wall extends generally upward from the perimeter of the bottom panel and terminates at an upper end. A basket interior is defined above the bottom panel and bounded by the side wall. A curved wall section of the side wall is curved concavely inward toward the basket interior. The bottom panel and the contiguous side wall, including the curved wall section, are formed of a primary material. A cushion pad is positioned generally at the upper end of the curved wall section and is formed from a secondary material that is softer than the primary material of the curved wall portion.

15 Claims, 2 Drawing Sheets

LAUNDRY BASKET WITH HIP HUGGING FEATURE

RELATED APPLICATION DATA

This patent is related to, claims priority from, and incorporates herein by reference U.S. Provisional Patent Application Ser. No. 60/445,278, which was filed on Feb. 5, 2003.

BACKGROUND OF THE INVENTION

1. Field of the Disclosure

The present disclosure is generally directed to laundry baskets, and more particularly to a laundry basket with a hip hugging feature.

2. Description of Related Art

Laundry baskets are well known as aids for doing laundry, and particularly for carrying and transporting either dirty laundry items or already laundered items. A typical laundry basket is somewhat rectangular and has a contiguous side wall with two elongate walls and two shorter end walls. The basket also has a bottom panel coupled to the contiguous side wall, an open top, and a basket interior. Laundry baskets are also known to have shapes that are not rectangular, such as round or cylindrical laundry baskets.

A relatively recent improvement in laundry baskets is to provide the basket in a kidney-shape, wherein one of the elongate sides is slightly concavely curved inward toward the basket interior and the opposite elongate side is outwardly or convexly curved away from the basket interior. U.S. Design Pat. No. D416,116 (issued to Sofy) discloses an example of a laundry basket that is a hybrid of a non-rectangular basket shape and one that has an inwardly curved side.

The inwardly curved side of such a laundry basket is typically used as an ergonomic tool to assist a user in carrying the basket, especially when it is loaded with laundry items. A user can rest the inwardly curved side of the basket against their hip, so that the basket rests on their pelvic bone or against their skin above the pelvic bone. The user can use their arm to grasp the opposite side of the basket to support and hold the basket with only one hand. Thus, the user has one hand free to open and close doors or to perform other needed tasks while carrying a load of laundry.

One problem with this type of laundry basket is that the inwardly curved edge of the basket can dig into a user's hip which can cause discomfort. Another problem is that the basket can slip from their hip relatively easily while it is being carried. Laundry baskets are typically made from a relatively smooth, shiny, and, thus, relatively slippery plastic material. Further, a typical laundry basket has an outwardly rolled rim at the top end of the contiguous side wall. The exposed edge of the rolled rim typically is the portion of the basket that bears against the user's side, digging into the flesh of the user causing the discomfort.

BRIEF DESCRIPTION OF THE DRAWINGS

Objects, features, and advantages of the present invention will become apparent upon reading the following description in conjunction with the drawing figures, in which.

DETAILED DESCRIPTION OF THE DISCLOSURE

The present invention is generally directed to improving upon laundry baskets with a hip hugging feature. The problems discussed above that relate to hip hugger type laundry baskets are addressed herein by incorporating a cushion or padded element to the laundry basket at each location on the laundry basket that is curved for contact with a user's hip.

Figure 1:
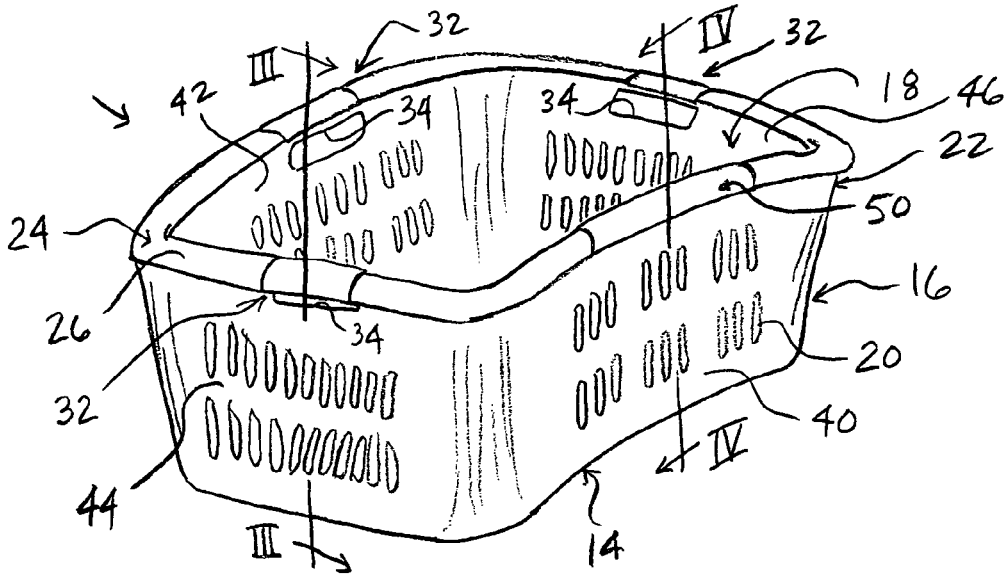
FIG. 1 shows a perspective view of one example of a laundry basket with a hip hugging feature constructed in accordance with the teachings of the present invention.
Figure 2:
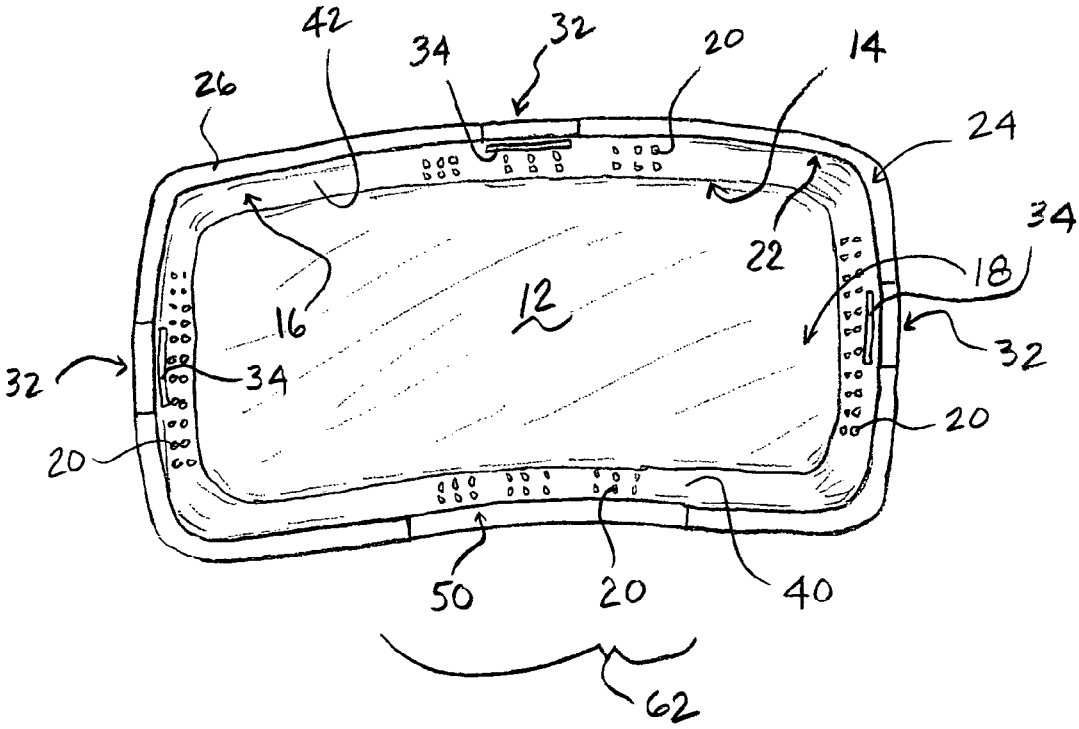
FIG. 2 shows a top view of the laundry basket shown in FIG. 1.

Referring now to the drawings, FIGS. 1 and 2 illustrate a laundry basket 10 constructed in accordance with the teachings of the present invention. The basket 10 includes a bottom panel 12 having a perimeter 14 and a contiguous side wall 16 that extends generally upward from the bottom panel perimeter. The bottom panel 12 and contiguous side wall 16 generally define a basket interior above the bottom panel and bounded by the side wall.

As is known to those having ordinary skill in the art, the bottom panel 12 can include ribs, ridges, and other suitable formations in the panel to provide structural rigidity, resting pads for the basket, and/or other features desired for a particular laundry basket. Additionally, it is well known in the art to form the bottom panel 12 and side wall 16 as an integral one-piece plastic molded structure. Any number of materials are suitable for forming such a laundry basket. These include, but are certainly not limited to, polyethylene, polypropylene, polystyrene, or the like. The present invention is not intended to be limited to a particular material for the laundry basket 10. Instead, hardness and surface characteristics of the basket material in comparison to other parts of the laundry basket come into play as discussed below. The material of the bottom panel and side wall are hereinafter referred to as the primary basket material.

Also as is well known to those having ordinary skill in the art, the side wall 16 can include a plurality of perforations or openings 20 passing through the wall to the interior 18. The plural perforations 20 can be patterned, shaped, arranged, and configured as desired. Typically, the perforations permit air to reach laundry items held in the basket interior. The perforations 20 also aid in reducing the weight and the amount of material necessary to form the laundry basket 10. However, the particular shape and placement of such perforations can be designed to provide a particular aesthetic appearance while retaining its necessary degree of structural rigidity.

Figure 4:
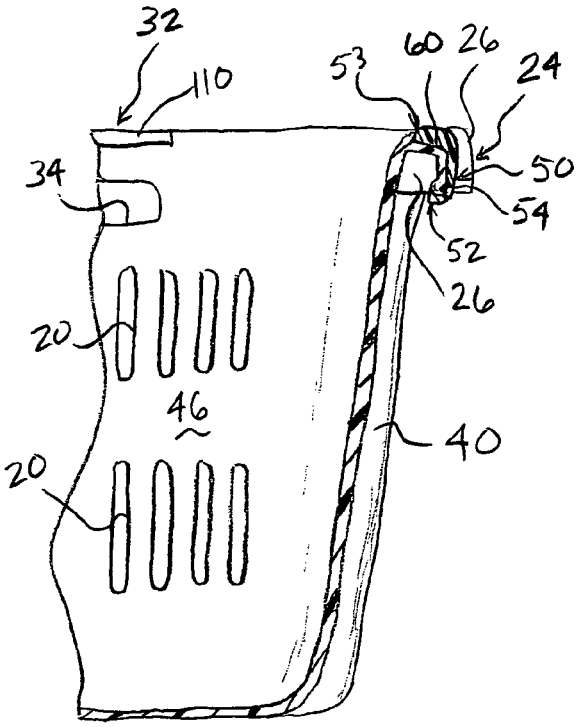
FIG. 4 shows a cross section of the hip hugging feature illustrated in FIGS. 1 and 2 and taken along line IV-IV of FIG. 1.
Figure 3:
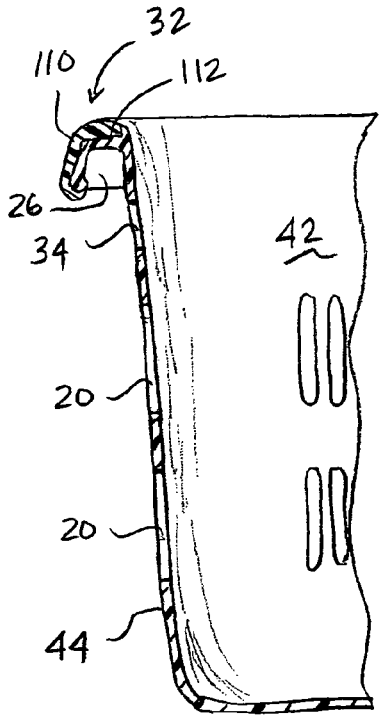
FIG. 3 shows a cross section of a handle of the laundry basket shown in FIGS. 1 and 2 and taken along line III-III in FIG. 1.

As illustrated in FIGS. 1 and 2, a lower end of the side wall 16 transitions into the perimeter of the bottom panel and the side wall terminates at an upper end 22. As illustrated in FIGS. 3 and 4, it is common for a laundry basket such as the basket 10 to include an inverted rim 24 extending upward and outward from the upper end 22 of the side wall 16. The rim 24 adds strength and rigidity to the overall structure of the basket 10 and also provides a smooth, blunt surface at the wall upper end 22. In this example, the rim 24 is an arch with a concavely curved recessed underside. Higher end laundry baskets can include a plurality of ribs traversing across the underside of the rim structure for additional support and rigidity, though such ribs are not shown herein.

In this disclosed example, the arched rim 24 includes a curved rim wall 26 that extends upward from the upper end 22 of the side wall 16 and gradually curves outwardly from the side wall and back down in the general direction of the bottom panel. A terminal edge of the rim wall 26 can include an enlarged thickness, integral plastic bead 30, which can be rounded to reduce the sharpness of the exposed edge. The bead 30 can also add limited structural rigidity to the rim 24 and, hence to the basket 10.

As depicted in FIGS. 1 and 3, the laundry basket 10 can also include one or more handles 32 provided at strategic locations on the side wall 16 near the upper end 22. The structure of the handles 32 can vary considerably and yet fall within the spirit and scope of the invention. In the disclosed example, the handles 32 are formed by providing a grip opening 34 through the side wall 16 near the upper end 22 but below the rim 24 at each desired location for a handle. Thus, a user can firmly grip the basket by wrapping their hands around the rim 24 at one or two handle locations and by passing their fingers and/or thumb through the grip opening 34.

As will be evident to those having ordinary skill in the art, handles need not be provided on a given laundry basket 10. A user could simply grip the rim to carry such a basket. Alternatively, handles can be provided simply by adding surface contours, depressions, and/or the like to the rim 24 at desired handle locations. Such contours can be provided to identify handle locations to the user and to provide a comfortable grip on the rim 24 without actually providing grip openings 34 through the side wall of the basket.

As an option, one or more of the handles 32 can be formed herein having a padded handle cover. This option is described in greater detail below.

Returning again to FIGS. 1 and 2, the side wall 16 in the disclosed example has a plurality of interconnected side wall sections. A pair of elongate side walls sections 40 and 42 are positioned opposite one another across the basket interior 18 and a pair of shorter end wall sections 44 and 46 are positioned opposite one another across the basket interior. In this disclosed example, the elongate side walls sections 40 and 42 are longer than the end wall sections 44 and 46, thus, giving the laundry basket 10 an overall generally rectangular shape. However, the side wall sections are slightly curved as are the end wall sections providing a more or less kidney-shaped basket.

Specifically, the side wall section 40 is concavely curved inward into the basket interior 18 to provide a hip hugging feature. Though not necessary, the side wall section 42 is convexly curved outward away from the basket interior. In this example, the side wall sections 40 and 42 generally follow the same contour, although this is also not necessary. The contour of the curvature or non-curvature of the side walls can be different between the two sections 40 and 42, if desired.

In this example, the end wall sections 44 and 46 each are convexly curved slightly outward away from the basket interior 18 giving the basket 10 rounded ends. The corners of the basket 10 where side wall sections 40 and 42 transition to end wall sections 44 and 46 are rounded in this example as well. As will be evident to those having ordinary skill in the art, the contiguous side wall 16 could take on any number of different configurations and constructions and need not have a kidney shape or a rectangular shape. However, in accordance with the teachings of the present invention, the side wall 16 must have at least one side wall section or region that is inwardly curved like the side wall 40 to provide a hip hugging feature.

As shown in FIGS. 1 and 4, a portion of the rim wall 26 of the rim 24 that corresponds the position of the inwardly curved side wall section 40 includes what is described herein as a cushion pad 50. In the disclosed example, as best illustrated in FIG. 4, the cushion pad 50 is formed from a secondary material that is different from the primary material used to manufacture bottom panel 12, side wall 16, and the rim 24 of the laundry basket 10. The secondary material of the cushion pad 50 is softer than the primary material and, thus, provides a cushioned area on the curved hip contacting portion of the basket 10. In one example, the cushion pad 50 is formed from a thermoplastic elastomer material (TPE) or other such relatively soft, resilient, and durable material. In another example, the cushion pad 50 can also be formed from a durable open cell foam with or without a skin layer, or can be formed from a closed cell foam material if desired.

Preferably, the secondary material of the cushion pad 50 has a lower Shore hardness, and thus is a less hard material as compared to the primary plastic material of the basket. The Shore hardness can be measured using any suitable Durometer apparatus and under either a Shore A or Shore D scale, for example. The thickness of the cushion pad 50 can also vary as desired for a particular basket application. As shown in FIG. 4, however, the cushion pad 50 preferably covers a good portion of the rim wall 26 in the hip hugging region of the wall section 40. In this example, the cushion pad 50 has a lower edge 52 that extends downward to cover at least most of the terminal end, which is the bead 30 in this example, of the rim 24. Also in this example, the pad 50 has an upper edge 53 that extends upward along the rim wall 26 far enough to at least completely cover the outer facing side of the rim wall 26. In this manner, the cushion pad 50 will be the only material part that contacts a users hip during use. For the wall section 40 in this example, only the material of the cushion pad 50 is exposed and can contact the user's hip.

In one example, the cushion pad 50 is also formed from a material that has a friction enhancing surface 54. The friction enhancing surface preferably provides a higher coefficient of friction than the primary material of the laundry basket adjacent the cushion pad 50. The friction enhancing surface can help to inhibit the laundry basket from sliding down the hip of a user while carrying a loaded basket 10.

The friction enhancing surface 54 can be formed on the pad in any suitable manner. For example, the surface can be inherently formed as a part of the cushion pad 50 by utilizing a elastomer, rubber, or other suitable material that has an inherently tacky surface. In one alternative, the surface of the cushion pad 50 can be treated during its formation to provide the friction enhancing characteristic. In another alternative, a surface treatment can be added to or performed on the surface of the pad 50 to increase its tackiness. As a further alternative, an additional layer (not shown) can be added to define the surface 54 of the cushion pad in order to render the surface more tacky. It is intended only that the friction enhancing surface 54, if present, increase the coefficient of friction of the cushion pad 50, as compared to the remaining exposed primary material of the laundry basket 10.

A number of methods and constructions can be employed to provide or create the cushion pad 50 on the inwardly curved elongate side wall section 40 of the laundry basket 10 disclosed herein. As represented in FIG. 4, a recess or pocket 60 can effectively be formed, depending upon the manufacturing process utilized, in a hip hugging region 62 of the rim 24 on the basket 10. In one example, the basket 10 including the recess 60 can be formed from the primary material in a basket mold by a suitable process, such as by injection molding. A separate process can be undertaken to form the cushion pad 50 from the secondary material to have a shape such that it can fit in and seat within the recess 60. The pad 50 can subsequently be adhered within the recess 60. In such a process, the cushion pad 50 can be adhered using an adhesive, heat welding, molecular bonding, or other like means.

In another alternative example, the cushion pad 50 can be formed from the secondary material during an initial molding, extrusion, or other suitable process. The preformed pad 50 can then be placed as an insert into and held within a larger mold cavity configured to mold the laundry basket 10. The laundry basket primary material can then be shot into the mold cavity to subsequently form the basket 10 around the pad 50 insert. The primary material of the laundry basket 10 would flow around the pad, form the shape of the recess 60, and encompass the pad material other than the surfaces borne against the basket mold cavity. A recess 60 would be effectively formed in this example as well. The resulting basket and pad structure would be essentially the same as that shown in FIG. 4 and described in the first example.

The molding processes, bulk materials, and material temperatures can be manipulated such that, during an insert or in-molding process, the secondary material of the cushion pad 50 and the primary material of the basket 10 become bonded with one another. Alternatively, an active adhesive layer can be added to the appropriate surfaces of the cushion pad 50 prior to being inserted into the basket mold cavity. The basket can then be molded around the pad 50. The adhesive layer will activate to bond the cushion pad 50 to the primary material of the basket 10.

In another alternative, though not shown, a basket can be formed having a uniform rim surface on the rim 24 with no recess 60. An add-on cushion pad or cushion layer can simply be secured, adhered, molded onto, or otherwise attached to the uniform surface of the rim 24. The effect would be the same in that a cushion pad would still be positioned in the hip hugging region 62 of the concavely curved side wall section 40.

Figure 5:
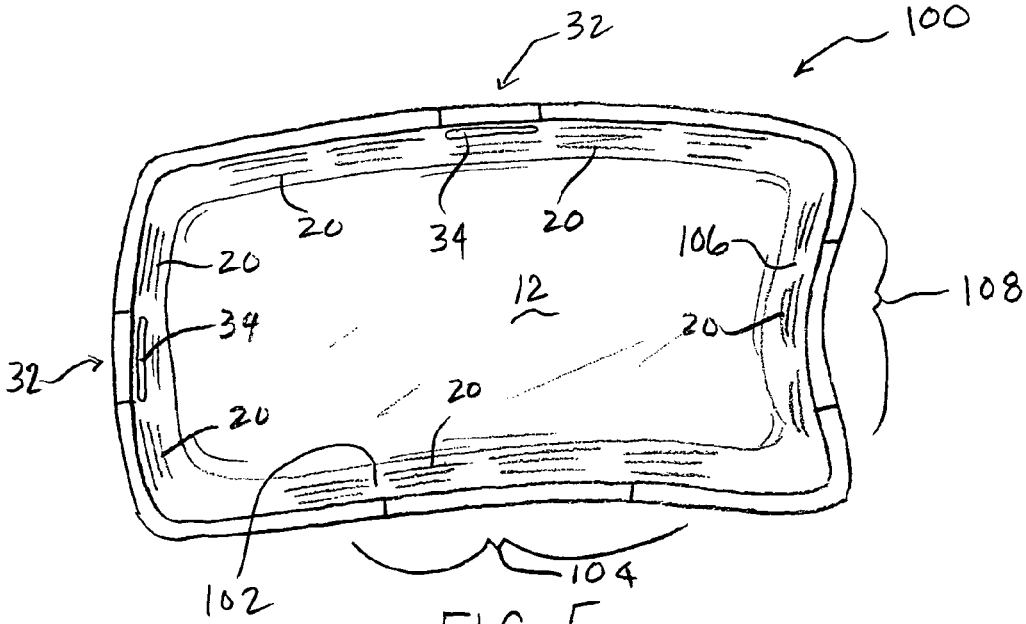
FIG. 5 shows a top view of an alternative embodiment of a laundry basket with multiple hip hugging features constructed in accordance with the teachings of the present invention.

In an alternative embodiment illustrated in FIG. 5, a second hip hugging region can be added to another section of the basket side wall. A basket 100 is illustrated in FIG. 5 and has a first elongate inwardly curved side wall section 102 providing a first hip hugging rim region 104. The basket 100 also has an inwardly curved end wall section 106 defining a second hip hugging rim region 108. A user can hold the basket 100 with either the elongate side wall section 102 or the shorter end wall section 106 born against their hip as desired.

As illustrated in FIG. 3, each handle can also have a grip pad 110 that is constructed and formed in the same manner as the cushion pad 50. The grip pad 110 can, if desired, also interact with a recess 112 effectively formed in the rim 24 of the basket 10. Thus, each handle 32 can provide a comfortable grip that eliminates any sharp edges of the handle or rim at a handle location. The grip pad 110 can be formed from the same secondary material as the cushion pad, or some other material that is softer than the primary material of the basket.

Although certain laundry basket examples have been described herein in accordance with the teachings of the present disclosure, the scope of coverage of this patent is not limited thereto. On the contrary, this patent covers all embodiments of the teachings of the disclosure that fairly fall within the scope of permissible equivalents.

What is claimed is:

1. A laundry basket comprising:

a bottom panel having a perimeter;

a contiguous side wall extending generally upward from the perimeter of the bottom panel, the side wall terminating at an upper end;

a rim having a rim wall extending around and generally outwardly from the upper end of the side wall, said rim wall including an outwardly facing portion;

a basket interior defined above the bottom panel and bounded by the side wall;

a first curved wall section of the side wall that is curved concavely inward toward the basket interior and a second wall section of the side wall that is disposed opposite to the first curved wall section, the bottom panel and the contiguous side wall including the first curved wall section and the second wall section being formed of a primary material, the primary material having a first coefficient of friction;

a recess formed in the outwardly facing portion of the rim wall and positioned in the first wall section;

a handle having a grip opening provided on the second wall section near the upper end and positioned opposite the first curved wall section; and a cushion pad positioned in and covering the recess such that it is coextensive with the rim wall only in the first curved wall section, the cushion pad oriented such that the cushion pad faces a user when the user carries the laundry basket using the handle, the cushion pad being formed from a secondary material that is softer than the primary material and the secondary material being arranged to present a friction enhancing surface having a second coefficient of friction greater than the first coefficient of friction wherein the first curved wall section is devoid of a handle having a grip opening.

2. The laundry basket according to claim 1, wherein the side wall has a pair of opposed shorter end sections, wherein a second handle is provided on one of the opposed shorter end sections.

3. The laundry basket of claim 1, wherein the portion of the handle adjacent the grip opening is covered with the secondary material.

4. The laundry basket of claim 1, wherein the secondary material comprises a thermoplastic elastomer having a Shore A or Shore D hardness that is less than a Shore A or Shore D hardness of the primary material.

5. The laundry basket of claim 1, wherein the rim is an arched rim and includes a rim wall having an enlarged lower edge.

6. The laundry basket of claim 5, wherein the enlarged lower edge comprises an integral bead.

7. The laundry basket of claim 1 wherein the primary material is polyethylene.

8. The laundry basket of claim 1 wherein the primary material is polypropylene.

9. The laundry basket of claim 1 wherein the side wall includes a plurality of perforations.

10. The laundry basket of claim 1 wherein the secondary material is a foam.

11. The laundry basket of claim 10 wherein the foam is an open cell foam.

12. The laundry basket of claim 10 wherein the foam is closed a cell foam.

13. The laundry basket of claim 2 wherein one of said end sections is curved concavely inward toward the basket interior and includes a second cushion pad oriented such that the second cushion pad faces a user when the user carries the laundry basket using the second handle, the second cushion pad being softer than the primary material and being arranged to present a friction enhancing surface having a second coefficient of friction greater than the first coefficient of friction.

14. The laundry basket of claim 1 wherein the primary material is polystyrene.

15. The laundry basket according to claim 1, wherein the secondary material is thermoplastic elastomer.

* * * * *